US008558459B2

(12) United States Patent
Busse et al.

(10) Patent No.: US 8,558,459 B2
(45) Date of Patent: Oct. 15, 2013

(54) ELECTRONIC BALLAST AND METHOD FOR OPERATING AN ELECTRICAL LAMP

(75) Inventors: Olaf Busse, München (DE); Bernhard Schemmel, Wessling (DE)

(73) Assignee: Osram Gesellschaft mit Beschraenkter Haftung, Munich (DE)

( * ) Notice: Subject to any disclaimer, the term of this patent is extended or adjusted under 35 U.S.C. 154(b) by 774 days.

(21) Appl. No.: 12/224,798

(22) PCT Filed: Mar. 5, 2007

(86) PCT No.: PCT/EP2007/052030
§ 371 (c)(1),
(2), (4) Date: Sep. 5, 2008

(87) PCT Pub. No.: WO2007/101830
PCT Pub. Date: Sep. 13, 2007

(65) Prior Publication Data

US 2009/0096390 A1 Apr. 16, 2009

(30) Foreign Application Priority Data

Mar. 9, 2006 (DE) ..... 10 2006 010 996

(51) Int. Cl.
*H05B 37/02* (2006.01)

(52) U.S. Cl.
USPC ..... 315/105; 315/106; 315/107; 315/307

(58) Field of Classification Search
USPC ..... 315/94, 105, 106, 107, 119, 209 R, 315/227 R, 225, 291, 297, 307, 308
See application file for complete search history.

(56) References Cited

U.S. PATENT DOCUMENTS

| | | | | |
|---|---|---|---|---|
| 5,583,399 | A | 12/1996 | Rudolph | |
| 5,789,866 | A * | 8/1998 | Keith et al. | 315/105 |
| 6,140,771 | A * | 10/2000 | Luger et al. | 315/101 |
| 6,972,531 | B2 * | 12/2005 | Krummel | 315/309 |
| 7,432,662 | B2 * | 10/2008 | Busse | 315/209 T |
| 2003/0122499 | A1 * | 7/2003 | Busse et al. | 315/209 R |
| 2004/0113570 | A1 * | 6/2004 | Ribarich et al. | 315/307 |
| 2006/0138968 | A1 * | 6/2006 | Bakre | 315/209 R |

FOREIGN PATENT DOCUMENTS

| | | | |
|---|---|---|---|
| EP | 1 672 963 | A2 | 6/2006 |
| JP | 6-13187 | A | 1/1994 |
| JP | 2000-21592 | A | 1/2000 |

* cited by examiner

*Primary Examiner* — David H Vu

(57) ABSTRACT

An electronic ballast for an electrical lamp (2) provided with a first (21) and a second filament (22), includes a heating device which is used to heat the filaments (21, 22) and includes a resonance circuit (5), and an evaluation unit (11) designed for the evaluation of at least one measuring value of an electrical parameter during pre-determinable adjustments of operating conditions of the resonance circuit (5). The number of filaments (21, 22) of the electrical lamp (2) in electrical contact with the electronic ballast (1) can be identified according to the measuring value, and the electrical lamp (2) can be switched on by the electronic ballast (1) according to the identified number. A method for operating an electrical lamp by an electronic ballast is also described.

20 Claims, 1 Drawing Sheet

ELECTRONIC BALLAST AND METHOD FOR OPERATING AN ELECTRICAL LAMP

TECHNICAL FIELD

Figure 1:
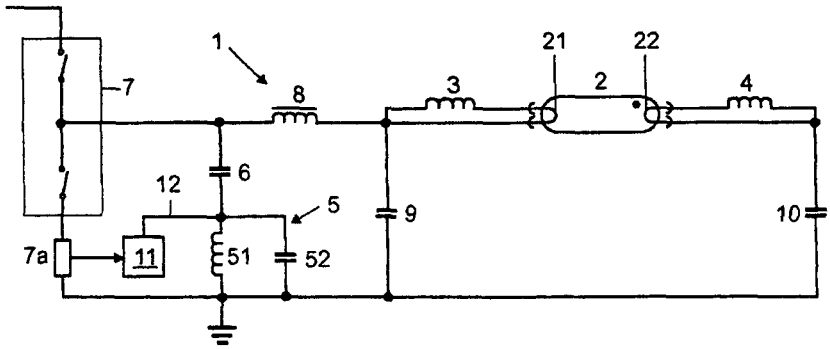

The invention relates to an electronic ballast for an electrical lamp with a first lamp filament and a second lamp filament, the electronic ballast having a heating apparatus with a resonant circuit for heating the lamp filaments. The invention also relates to a method for operating an electrical lamp by means of an electronic ballast.

PRIOR ART

Electrical lamps, in particular gas discharge lamps, are set and operated by means of electronic ballasts. It is essential here that the electronic ballasts can only start or ignite an electrical lamp when the electrical lamp is inserted properly into a luminaire. For this purpose it is necessary that an interrogation is carried out which makes it possible to identify whether lamp filaments are in proper electrical contact.

In the case of conventional electronic ballasts, a DC signal path is designed for this purpose which allows for such an interrogation of the filaments. The interrogation of the filaments therefore takes place exclusively by means of a DC start-up path via the lamp filaments. This DC start-up path generally comprises high-voltage resistors, but these are at risk of failure. As a result, the identification process to ascertain whether an electrical lamp is inserted properly into a luminaire cannot always be ensured in a reliable manner.

If an electronic ballast has a heating apparatus for heating the lamp filaments in the form of transformer-type filament heating, the DC start-up path needs to be decoupled from the heating winding by means of diodes or capacitors.

With the known electronic ballasts, a considerable degree of complexity in terms of circuitry is therefore required in order to be able to carry out a filament interrogation. Furthermore, with the configuration of an electronic ballast with a DC start-up path, only the monitoring of one lamp filament of the electrical lamp is provided.

DESCRIPTION OF THE INVENTION

The object of the present invention is therefore to provide an electronic ballast for an electrical lamp and a method for operating an electrical lamp, with which ballast and method a lamp filament interrogation can be carried out safely and with little complexity.

This object is achieved by an electronic ballast which has a first lamp filament and a second lamp filament, which ballast has a heating apparatus for heating the lamp filaments, the heating apparatus comprising a resonant circuit, characterized by an evaluation unit, which is designed to evaluate at least one measurement value of an electrical parameter given predeterminable settings of operating conditions of the resonant circuit, it being possible to identify, depending on the measurement value, how many lamp filaments of the electrical lamp are in electrical contact with the electronic ballast and it being possible for the electrical lamp to be switched on by the electronic ballast depending on this number identified and by a method for operating an electrical lamp the electrical lamp having a first lamp filament and a second lamp filament, and the electronic ballast comprising a heating apparatus with a resonant circuit for heating the lamp filaments, characterized in that at least one value of an electrical parameter given predetermined settings of operating conditions of the resonant circuit is measured and evaluated by an evaluation unit of the electronic ballast, and the measured value is used to identify how many lamp filaments of the electrical lamp are in contact with the electronic ballast, and the electrical lamp is switched on by the electronic ballast depending on this number identified.

An electronic ballast in accordance with this solution is designed to operate an electrical lamp. The electrical lamp has a first lamp filament and a second lamp filament. The electronic ballast comprises a heating apparatus which has a resonant circuit and which is designed to heat the lamp filaments. Furthermore, the electronic ballast comprises an evaluation unit, which is designed to evaluate at least one measurement value of an electrical parameter given predeterminable and settable operating conditions of the resonant circuit. The electronic ballast, and in particular the evaluation unit, are designed in such a way that it is possible to identify, depending on the measurement value, how many lamp filaments of the electrical lamp are properly in contact with the electronic ballast. The electrical lamp can be switched on by the electronic ballast depending on this number identified. The electronic ballast makes it possible in a simple manner involving little complexity to safely identify whether an electrical lamp is properly inserted into a luminaire. The electronic ballast can be realized virtually without any additional complexity in terms of circuitry and nevertheless makes it possible to monitor all of the lamp filaments of an electrical lamp for proper insertion of the electrical lamp into the luminaire and therefore proper electrical contact.

The electronic ballast is preferably designed without a DC signal path for the lamp filament interrogation of the electrical lamp. The complexity in terms of circuitry of the electronic ballast can thereby be markedly reduced and the interrogation of the lamp filaments can be made possible not only for one lamp filament but for all of the lamp filaments of the electrical lamp. This makes it possible to obtain much more reliable information as to whether the electrical lamp is inserted properly into a luminaire and, as a result, safe starting of the electrical lamp can be made possible by means of the electronic ballast.

Preferably, the evaluation unit is designed in such a way that, when setting the resonance values of the operational parameters of the resonant circuit, a measurement value of the electrical parameter can be detected and, depending on a comparison of the measurement value with a predeterminable threshold value measurement value, the number of lamp filaments connected can be determined. In this case, the threshold value measurement value corresponds to a theoretical value for an electrical parameter in the event of resonance of the resonant circuit and, depending on the discrepancy between the measured measurement value and this threshold value measurement value, it is possible to identify whether none, one or both of the lamp filaments of the electrical lamp are in electrical contact and the electrical lamp is therefore properly inserted into the luminaire.

It can be provided that the measurement value can be ascertained by means of a power measurement at a resistor in a half-bridge circuit of the electronic ballast. As a result, a measurement value can be detected in a simple manner involving little complexity in a circuit region of the electronic ballast, with this circuit region of the electronic ballast being formed in any case. Additional complexity in terms of circuitry is therefore no longer required.

It can also be provided that a separate measurement path is formed which is electrically connected to the resonant circuit. For switching-on of the electrical lamp by the electronic ballast, the number of lamp filaments identified is preferably equal to the total number of lamp filaments of the electrical lamp. The electrical lamp is therefore only brought into operation by the electronic ballast when it is safely identified that all of the lamp filaments of the electrical lamp are connected to the electronic ballast and the electrical lamp is inserted properly into the luminaire.

Advantageously, the electronic ballast is only designed for the operation of a single lamp type of an electrical lamp. This makes it possible to precisely predetermine a threshold value measurement value and, depending on this value, to safely identify to what extent a measured measurement value deviates from this threshold value measurement value, as a result of which it is also possible to ensure reliable information on the number of lamp filaments connected.

In a method in accordance with the solution, an electrical lamp is operated by means of an electronic ballast, the electrical lamp having a first lamp filament and a second lamp filament, and the electronic ballast comprising a heating apparatus with a resonant circuit for heating the lamp filaments. Given predeterminable settings of operating conditions of the resonant circuit, in particular resonance conditions of the resonant circuit, at least one value of an electrical parameter is measured and evaluated by an evaluation unit of the electronic ballast. This measured value is used to identify how many lamp filaments of the electrical lamp are in electrical contact with the electronic ballast or are connected to the electronic ballast and the electrical lamp is switched on by the electronic ballast or not, depending on this number identified. The method according to the solution makes low-complexity interrogation of the lamp filaments for safe starting of the electrical lamp possible. By means of the proposed method, all of the lamp filaments of an electrical lamp can be checked for proper electrical contact.

Preferably, when setting the resonance values of the operational parameters of the resonant circuit, a value of the electrical parameter is detected and, depending on a comparison of this measurement value with a predeterminable threshold value measurement value, the number of lamp filaments connected is determined.

Preferably, the electrical lamp is switched on by the electronic ballast when the number of lamp filaments identified is equal to the actual number of lamp filaments of the electrical lamp. Precisely then, the electrical lamp is inserted properly into the luminaire and safe operation can then take place.

With the proposed electronic ballast and the proposed method, in which a resonant preheating concept of the lamp filaments with a heating transformer is used, the resultant degree of resonance of the resonant circuit can be used to decide how many of the lamp filaments of the electrical lamp are connected to the electronic ballast. Only when it is identified that all of the lamp filaments of the electrical lamp are connected properly does the electronic ballast begin normal starting of the electrical lamp. The voltages across the electrical lamp which are set during an interrogation of the lamp filaments can be selected in a simple manner involving little complexity in such a way that there are no infringements of any safety standards for the operation. The proposed concept is particularly suitable in the case of electronic ballasts in which a relatively inexpensive processor is used.

Further advantageous configurations of the electronic ballast can be considered advantageous configurations of the method according to the invention.

BRIEF DESCRIPTION OF THE DRAWING(S)

Figure 2:
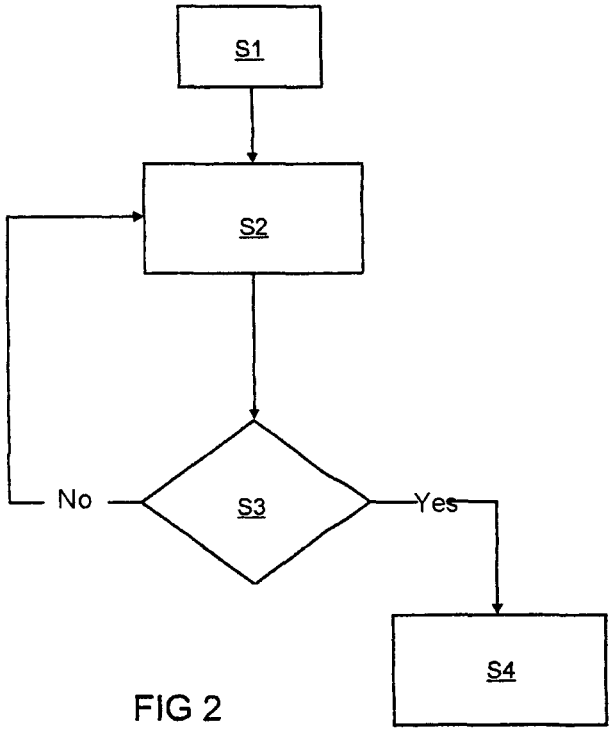

An exemplary embodiment of the invention will be explained in more detail below with reference to schematic drawings in which:

FIG. 1 shows a circuit arrangement of an electronic ballast with an electrical lamp in accordance with an exemplary embodiment of the invention; and FIG. 2 shows a flowchart of an exemplary embodiment of a method according to the invention.

PREFERRED EMBODIMENT OF THE INVENTION

FIG. 1 shows a circuit arrangement, in which the essential circuit parts of an electronic ballast 1 and an electrical lamp 2 are shown for the purposes of understanding the invention. The electronic ballast 1 is designed for operating and setting a single lamp type of an electrical lamp 2. The electrical lamp 2 has a first lamp filament 21 and a second lamp filament 22. For proper operation, the electrical lamp 2 is inserted into a luminaire, and the lamp filaments 21 and 22 come into electrical contact with the electronic ballast 1.

The electronic ballast 1 is designed without a DC start-up path for the interrogation of the lamp filaments 21 and 22. The electronic ballast 1 comprises a heating apparatus in the form of a heating transformer for preheating the lamp filaments 21 and 22.

This heating apparatus comprises a lamp filament series inductor 3, which is electrically connected to the first lamp filament 21 and is in the form of a winding of a heating transformer. Furthermore, the heating apparatus comprises a lamp filament series inductor 4 which is electrically connected to the second lamp filament 22. This is again shown in the arrangement connected to corresponding filament 22. Furthermore, the heating apparatus has a resonant circuit 5, which comprises an inductor 51 and a capacitor 52 connected in parallel therewith.

The lamp filament series inductors 3 and 4 form a secondary side of the heating transformer. The primary side of the heating transformer is formed by the inductor 51 of the resonant circuit, with corresponding energy generation taking place in the secondary circuit of the heating transformer, depending on the settings of the operating conditions of the resonant circuit.

A capacitor 6, which is in the form of a trapezoidal capacitor, is electrically connected to the resonant circuit 5. This capacitor 6 makes it possible to achieve no-load switching of a half-bridge circuit 7. Furthermore, a lamp inductor 8 and a resonant capacitor 9 and a coupling capacitor 10 are connected into the circuit arrangement.

Furthermore, the electronic ballast 1 comprises an evaluation unit 11, which is designed to evaluate at least one measurement value of an electrical parameter given predeterminable settings of the operating conditions of the resonant circuit 5.

In a first configuration, it can in this case be provided that the evaluation unit 11 is designed to detect a measurement value which can be ascertained by means of a power measurement at a resistor 7*a* of the half-bridge circuit 7 of the electronic ballast 1.

In accordance with a second alternative configuration, it can also be provided that the evaluation unit 11 is electrically connected to the resonant circuit 5 via a separate measurement path 12, and measurement value detection can take place via this measurement path 12.

The measurement value detected which is evaluated by the evaluation unit 11 can be used to identify how many lamp filaments 21 and 22 of the electrical lamp 2 are in proper contact with the electronic ballast 1. Depending on this identified number of properly contact-connected lamp filaments 21 and 22, the electrical lamp 2 can be started by the electronic ballast 1.

FIG. 2 is a simple illustration of a flowchart, in which, in accordance with a step S1, an interrogation of the lamp filaments 21 and 22 of the electrical lamp 2 is started. In the exemplary embodiment, the resonant frequency of the resonant circuit 5 is set and then a measurement value for an electrical parameter, in the exemplary embodiment an electrical voltage, is measured (step S2) for this purpose.

In accordance with a step S3, this measured value is compared with a predetermined threshold value measurement value, which, in the exemplary embodiment, corresponds to a threshold value voltage, which corresponds to the resonant voltage in the event of resonance of the resonant circuit 5 if all of the lamp filaments 21 and 22 are in proper contact and therefore the electrical lamp 2 is inserted into the luminaire and is ready for operation. Depending on this comparison, it is then possible to identify whether none or one or both of the lamp filaments 21 and 22 are properly connected to the electronic ballast 1.

If, in the comparison carried out in the evaluation unit 11, the measured measurement value is smaller than the threshold value measurement value, it is identified that none or only one of the lamp filaments 21 or 22 is connected to the electronic ballast 1 and therefore the electrical lamp 2 is not properly inserted into the luminaire. With such a result of the comparison of the measurement values, it is identified that the electrical lamp should therefore not be started.

There is then a further interrogation of the lamp filaments 21 and 22 and renewed detection of a measurement value in accordance with step S2. This loop is run through as often as necessary until the measured measurement value exceeds the threshold value measurement value in the comparison in step S3. Preferably, intervals between the runthrough cycles are provided. With this result of the comparison, it is then identified that, in the exemplary embodiment, the two lamp filaments 21 and 22 are in electrical contact with the electronic ballast 1 and the electrical lamp 2 is inserted into the luminaire for carrying out safe operation. In accordance with a step S4, the electronic ballast 1 is then started and the electrical lamp 2 is switched on by the electronic ballast 1.

The measured values are preferably rectified mean values of a plurality of measurement values.

The invention claimed is:

1. An electronic ballast for an electrical lamp comprising:
a first lamp filament and a second lamp filament;
a heating apparatus for heating the lamp filaments;
the heating apparatus comprising:
a resonant circuit having a primary inductor;
two secondary inductors forming a secondary side of a transformer in conjunction with the primary inductor of the resonant circuit;
an evaluation unit designed to evaluate at least one measurement value of an electrical parameter given predeterminable settings of operating conditions of the resonant circuit during heating;
wherein the evaluation unit identifies, depending on the measurement value, how many lamp filaments of the electrical lamp are in electrical contact with the electronic ballast and wherein the electrical lamp is switched on by the electronic ballast depending on this number identified.

2. The electronic ballast as claimed in claim 1, wherein it is designed without a DC signal path for the interrogation of a lamp filament of the electrical lamp.

3. The electronic ballast as claimed in claim 1, wherein the evaluation unit is designed in such a way that, when setting the resonance values of the operational parameters of the resonant circuit, a measurement value of the electrical parameter is detected and, depending on a comparison of the measurement value with a predeterminable threshold value measurement value, the number of lamp filaments connected are determined.

4. The electronic ballast as claimed in claim 1, wherein the measurement value is ascertained by means of a power measurement at a resistor in a half-bridge circuit of the electronic ballast.

5. The electronic ballast as claimed in claim 1, wherein a separate measurement path is formed which is electrically connected to the resonant circuit.

6. The electronic ballast as claimed in claim 1, wherein, for switching-on of the electrical lamp by the electronic ballast, the number of lamp filaments identified is equal to the total number of lamp filaments of the electrical lamp.

7. The electronic ballast as claimed in claim 1, wherein it is only designed for the operation of one lamp type of an electrical lamp.

8. A method for operating an electrical lamp by means of an electronic ballast, the electrical lamp having a first lamp filament and a second lamp filament, and the electronic ballast comprising a heating apparatus with a resonant circuit for heating the lamp filaments, the resonant circuit having a primary inductor and two secondary inductors forming a secondary side of a transformer in conjunction with the primary inductor of the resonant circuit wherein at least one value of an electrical parameter given predetermined settings of operating conditions of the resonant circuit is measured and evaluated by an evaluation unit of the electronic ballast, and the measured value is used to identify how many lamp filaments of the electrical lamp are in contact with the electronic ballast, and the electrical lamp is switched on by the electronic ballast depending on this number identified.

9. The method as claimed in claim 8, wherein, when setting the resonance values of the operational parameters of the resonant circuit, at least one value of the electrical parameter is detected and, depending on a comparison of this value with a predeterminable threshold value measurement value, the number of lamp filaments connected is determined.

10. The method as claimed in claim 8, wherein the electrical lamp is switched on by the electronic ballast when the number of lamp filaments identified is equal to the actual number of lamp filaments of the electrical lamp.

11. The method as claimed in claim 9, wherein the electrical lamp is switched on by the electronic ballast when the number of lamp filaments identified is equal to the actual number of lamp filaments of the electrical lamp.

12. The electronic ballast as claimed in claim 2, wherein the evaluation unit is designed in such a way that, when setting the resonance values of the operational parameters of the resonant circuit, a measurement value of the electrical parameter is detected and, depending on a comparison of the measurement value with a predeterminable threshold value measurement value, the number of lamp filaments connected are deter mined.

13. The electronic ballast as claimed in claim 2, wherein the measurement value is ascertained by means of a power measurement at a resistor in a half-bridge circuit of the electronic ballast.

14. The electronic ballast as claimed in claim 2, wherein a separate measurement path is formed which is electrically connected to the resonant circuit.

15. The electronic ballast as claimed in claim 2, wherein, for switching-on of the electrical lamp by the electronic ballast, the number of lamp filaments identified is equal to the total number of lamp filaments of the electrical lamp.

16. The electronic ballast as claimed in claim 2, wherein it is only designed for the operation of one lamp type of an electrical lamp.

17. The electronic ballast as claimed in claim 3, wherein the measurement value is ascertained by means of a power measurement at a resistor in a half-bridge circuit of the electronic ballast.

18. The electronic ballast as claimed in claim 3, wherein a separate measurement path is formed which is electrically connected to the resonant circuit.

19. The electronic ballast as claimed in claim 3, wherein, for switching-on of the electrical lamp by the electronic ballast, the number of lamp filaments identified is equal to the total number of lamp filaments of the electrical lamp.

20. The electronic ballast as claimed in claim 3, wherein it is only designed for the operation of one lamp type of an electrical lamp.

* * * * *